US005893629A

United States Patent [19]

Gubernick

[11] Patent Number: 5,893,629

[45] Date of Patent: Apr. 13, 1999

[54] FLASHLIGHT HAVING A LIGHT TUBE AND STAND

[76] Inventor: Franklin L. Gubernick, 2540 N. Rising Star Tr., Tucson, Ariz. 85745

[21] Appl. No.: 08/851,171

[22] Filed: May 5, 1997

Related U.S. Application Data

[60] Provisional application No.60/017,378, May 7, 1996.

[51] Int. Cl.[6] ..... F21L 7/00; F21V 9/16

[52] U.S. Cl. ..... 362/186; 362/84; 362/190; 362/208; 362/278; 362/320

[58] Field of Search ..... 362/186, 208, 362/84, 190, 278, 320

[56] References Cited

U.S. PATENT DOCUMENTS

| | | | |
|---|---|---|---|
| 1,362,324 | 12/1920 | Karl et al. | 362/208 |
| 2,614,206 | 10/1952 | Goad | 362/208 |
| 2,972,739 | 2/1961 | Opper | 362/190 |
| 3,418,651 | 12/1968 | Jacobson | 362/320 |
| 4,208,703 | 6/1980 | Orr | 362/190 |
| 4,740,874 | 4/1988 | Wylie et al. | 362/190 |
| 4,782,433 | 11/1988 | Rombough | 362/186 |
| 5,440,465 | 8/1995 | Hasness | 362/208 |

*Primary Examiner*—Alan Cariaso
*Attorney, Agent, or Firm*—Franklin Gubernick

[57] ABSTRACT

A marker flashlight and stand therefore is described. A tube of translucent, somewhat flexible material is adapted for releasable securement to the flashlight's lamp section. When the flashlight is turned on, almost the entire tube of translucent material is caused to glow. The tube can also be coated with a phosphorescent material so that it is capable of glowing even when the flashlight is not producing light. The tube can be removed from the flashlight's lamp section and placed about the body of the flashlight. The tube can be compressed so that the flashlight can still be received within a standard holster-type holder that has an interior area having a diameter approximately equal to the diameter of the flashlight's body. The tube may include a strap for enabling the tube to be attached to a user's clothing and be a holder for the flashlight.

The stand includes a wide base that is adjustably and releasably secured to the body of the flashlight. The stand can support the flashlight in a fixed position and can also be used to secure the flashlight to a user's clothing. An aperture is located at one end of the base so that the stand can be hung from an existing hook or nail. In an alternate embodiment of the stand, the base includes two pivotally attached outriggers that enable a user to increase the effective width of the base.

17 Claims, 5 Drawing Sheets

FLASHLIGHT HAVING A LIGHT TUBE AND STAND

This application claims the benefit of U.S. Provisional application Ser. No. 60/017,378, filed May 07, 1996.

FIELD OF THE INVENTION

The invention is in the field of flashlight accessories. More particularly, the invention includes apparatus designed to convert a conventional flashlight into a highly visible beacon or lantern. The apparatus includes a hollow tubular member made of a translucent, semi-reflective material that is preferably also flexible. When secured to the lamp portion of a conventional flashlight, the tubular member can be made to glow with light along its length and thereby provide a uniform and highly visible light source. The use of a phosphorescent coating on the tubular member is also taught as well as the use of the tubular member as a holder for the flashlight.

The invention also includes an adjustable stand designed to be secured to the rear portion of a conventional flashlight. Once in place, the stand can maintain the flashlight in an angled or upright orientation. The stand also enables the flashlight to be easily hung from a belt or secured to an existing nail or hook. The tubular member in combination with the stand converts a conventional flashlight into a lamp having a stable support.

BACKGROUND OF THE INVENTION

Most conventional flashlights have a tubular body designed to inwardly contain one or more batteries. Secured to one end of the body is a lamp portion that includes a parabolic reflector having a light bulb located at its center. A conventional flashlight will also typically include a switch and may include a clasp, hook or other type of member or aperture that enables the flashlight to be secured to a diverse element.

One problem with conventional flashlights is that the linear beam of light that they typically produce is unsuitable for use as a broadly viewable hazard marker/beacon or as a lantern. For a person who is trying to alert others to his or her presence, such as a stranded motorist or a pedestrian or bicyclist traveling at night, the tight beam of a flashlight is usually unsuitable since it cannot be seen unless the flashlight is pointed directly at the viewer. When a light source is required for dispersed lighting of an area, the narrow beam of a flashlight is not capable of illuminating a sufficiently large area to accomplish this function.

In the prior art, a number of flashlight modifications and accessories are taught for broadening a flashlight's light dispersal pattern. For example, there are flashlights in which the bulb can be moved out of the parabolic reflector and provide light in a dispersed manner. While this negates some of the prior art problems, the high intensity of the bulb can make it uncomfortable to look at. In addition, the small size of the bulb makes it a point-type light source that is easily blocked.

An additional method used to change a flashlight's narrow beam into a dispersed light source is to fit a long, rigid plastic tube of translucent material to the end of a flashlight. The tube absorbs a significant amount of the light and therefore is effective only with powerful flashlights. Furthermore, the tube is cumbersome to carry when not in use.

Another problem with prior art conventional flashlights is their instability when they are not being handheld. Many users have experienced frustration while attempting to prop up a flashlight so that it will shine on a particular desired area. In an effort to overcome this problem, there are prior art flashlights in which the lamp portion of the flashlight may be swiveled or adjustably positioned on the flashlight's body portion. However, this provides only a limited degree of success.

A third problem with prior art flashlights is that they are awkward to carry. To facilitate transport of a flashlight, a belt-mounted holder similar to a holster is often employed. However, initial securement of the holder can be somewhat bothersome since it requires a user to partially remove his or her belt to enable the belt to be inserted through the holder's securement loop.

SUMMARY OF THE INVENTION

The invention comprises a light tube and a stand, both adapted for installation on a conventional flashlight. The light tube and stand can be used together or individually on the flashlight. The light tube functions to convert the flashlight into a beacon or lantern. The stand provides the flashlight with an adjustable support and a means for conveniently hanging the flashlight from a user's belt or from an existing nail or hook.

The light tube is made of a translucent semi-reflective material. The tube is open at one end and preferably closed at its other end. The open end enables the tube to fit over the lamp portion of the flashlight. When the tube's open end is placed about the flashlight's lamp portion and the flashlight is actuated, the beam of light will be partially reflected within the tube so that the entire tube will appear to glow with light. As a result, the tube becomes a source of diffuse light that is capable of functioning as a highly visible beacon-type marker or as a lantern. Portions of the tube or the entire tube may be coated with a phosphorescent material to thereby enable at least portions of the tube to glow with light even when the flashlight is not producing light.

In the preferred embodiment, a flexible or semi-flexible fabric material is used for the light tube. This enables the light tube to be tightly compressed about the body of the flashlight when not in use. When a flexible material is employed for the light tube, a stiffening rod is preferably secured to the tube to maintain the tube's elongated shape. When a semi-flexible material such as a stiff rip-stop nylon fabric material is employed, a stiffening member is normally not required. In the preferred embodiment, the tube is white or red in color and the tube material is waterproof or water-resistant.

To prevent accidental disengagement of the light tube from the flashlight, an optional securement cord may be employed. As another option, the open end of the tube may include securement apparatus that functions to secure the tube to the flashlight. As an example of one such apparatus, the tube can include a circular elastic member that is stretched when the tube is placed over an end of the flashlight. As another example of a securement apparatus, complementary portions of hook and loop fastening material can be located about the open end of the tube and pinched together to decrease the size of the opening and thereby secure the tube to the flashlight.

In an alternative embodiment, the tube includes a flexible strap that is permanently secured at one end to the portion of the light tube proximate the light tube's open end. The strap has a length whereby a user can loop it around his or her belt or into a belt loop. Once the loop has been made, the free end can be releasably secured to the light tube via a conventional securement means such as complementary portions of hook and loop material (VELCRO), a snap assembly or a button-type fastener. The flashlight can then be inserted into the tube via the tube's open end and thereby be secured to the user.

The stand for the flashlight preferably includes a substantially planar base that is securable to the rear or butt portion of the flashlight. The base is adjustably fastened to the flashlight whereby the flashlight can be pivoted relative to the base. When the base is placed on a flat surface, it is capable of supporting the flashlight in whatever orientation is desired by the user. The stand can be used when the flashlight is producing a linear beam of light or when the light tube is attached and the flashlight is functioning as a lantern or beacon.

The base of the stand preferably includes a thru-hole that allows the base to be hung on an existing nail or hook without hampering the ability of the flashlight to be adjusted relative to the base. In addition, a user can slide the base behind his or her belt to thereby hang the flashlight from said belt. When the light tube is secured to the flashlight and the flashlight is thus hung from a user's belt, the flashlight then functions as an easily visible beacon or marker.

In alternate embodiments of the stand, the bottom surface of the base has a slightly bowed configuration so that it will more comfortably conform to a user's body when it is placed behind the user's belt. Also taught is a base having pivotable outriggers that are manually adjustable and function to enhance the base's stability.

DETAILED DESCRIPTION OF THE DRAWINGS

Figure 1:
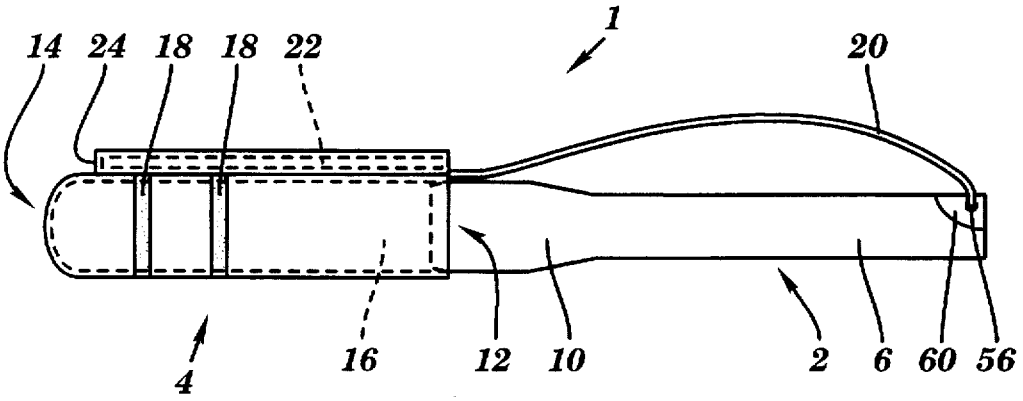
FIG. 1 is a side elevational view of a marker flashlight in accordance with the invention.

Referring now to the drawings in greater detail, wherein like reference numerals refer to like parts throughout the several figures, there is shown by the numeral 1 a marker flashlight in accordance with the invention.

The marker flashlight 1 comprises a conventional flashlight 2 and an attached light tube 4. The flashlight 2 includes a tubular body 6 that is substantially uniform in diameter and is designed to house one or more batteries (not shown). Secured to one end of the body is a frusto-conically shaped lamp portion 10. The lamp portion includes a parabolically-shaped reflector (not shown) and a high-intensity light bulb (not shown) located at the center of the reflector. As in most conventional flashlights, the lamp portion has a greater diameter than the body portion of the flashlight. It should be noted that this difference in diameters is not a required feature of the invention.

The light tube 4 is tubular in shape and has an open end 12 and a closed end 14. The opening in end 12 leads to a long open area 16 within the tube. The tube is made of a translucent, semi-reflective material so that when light is shined into area 16, at least some of the light will be internally reflected within the tube. As a result, the entire portion of the light tube that is located forwardly of the flashlight's lamp portion will appear to glow with light. The glowing portion will then act as a source of diffused light.

Figure 2:
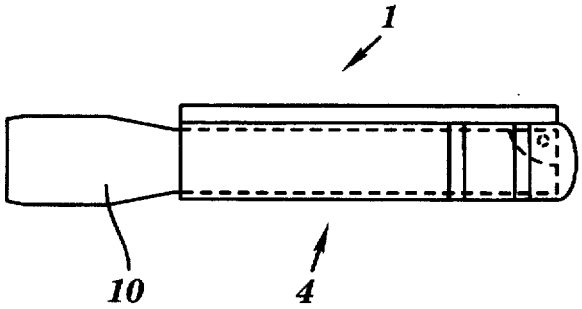
FIG. 2 is a side elevational view of the same marker flashlight as shown in FIG. 1. However, in this view, the light tube is located about the body of the flashlight.

It should be noted that the light tube 4 may be at least partially coated with a phosphorescent material such as a phosphorescent paint. The coating may be uniformly applied or applied in a pattern such as in rings or stripes. FIGS. 1 and 2 show the light tube having two rings 18 of a phosphorescent material applied to the exterior of the light tube. The use of a phosphorescent material allows the coated portion(s) of the light tube to glow with light even when the flashlight is not producing light. This saves battery power when the light 1 is being used as a beacon or marker since the unit will continually perform its function (providing an illuminated marker) even when a user is only intermittently operating the flashlight 2.

In the preferred embodiment, the light tube 4 is made of a somewhat stiff, rip-stop nylon fabric material. To manufacture the tube, a shaped sheet of the nylon material is rolled so that its side edges overlap. The side edges are then sewn together to thereby form the tubular configuration shown.

Area 16 within the tube is defined by the tube's thin sidewalls and has a diameter that is only slightly less than that of the tube itself. The diameter of area 16 is preferably substantially equal to the maximum diameter of the flashlight's lamp portion. The length of the light tube is preferably substantially equal to that of the flashlight's body portion. The use of a stiff nylon material for the fabrication of the light tube enables the tube to maintain the elongated shape shown in FIGS. 1, 2 and 4. As shown in FIG. 2, the light tube can also be placed about the body of the flashlight to thereby enable the flashlight to be used in the conventional manner. When placed in the position shown in FIG. 2, the light tube can be compressed about the flashlight's body portion to enable the flashlight to be placed within a conventional flashlight holder having a receiving pocket sized to only receive a device that has a diameter substantially equal to that of the flashlight's body portion.

Since area 16 of the tube has a diameter that is substantially identical to the maximum diameter of the flashlight's lamp portion, the light tube can be secured to the lamp portion by virtue of a tight fit of the tube's sidewalls (the fabric surrounding area 16) on the exterior surface of the lamp portion. To prevent inadvertent disengagement of the tube from the flashlight, a securement cord 20 is attached to both end 12 of the tube and to the flashlight. Securement of the cord to the flashlight is accomplished by either tying the end of the cord to the flashlight or through the use of a releasable fastener (not shown) secured to the end of the cord and to complementary structure on the flashlight. It should be noted that cord 20 is optional.

In some cases, it is desirable to employ a stiffening means to maintain the extended shape of the light tube. The use of a stiffening member is shown in FIG. 1 wherein a stiffening bar 22 is incorporated into the structure of the light tube. The side of the tube includes a pocket 24 that receives the bar in a secure and preferably permanent manner. In the preferred embodiment, the bar is made of a thin plastic material and has a length substantially equal to that of the body of the flashlight. It should be noted that while a bar is shown, the stiffening member may also be in the form of other well-known devices or members used to maintain a fabric member's shape. For example, the stiffening member may be replaced by a coil spring (not shown) located within area 16. The stiffening means may also be located exterior to the tube and not within a complementary pocket structure. It should be noted that a stiffening member is optional when the material used for the light tube has an inherent stiffness such as a heavy-weight nylon fabric. If the light tube is made out of a flexible material such as thin cotton fabric, a stiffening member would most likely have to be added to achieve the functionality of the invention.

Figure 3:
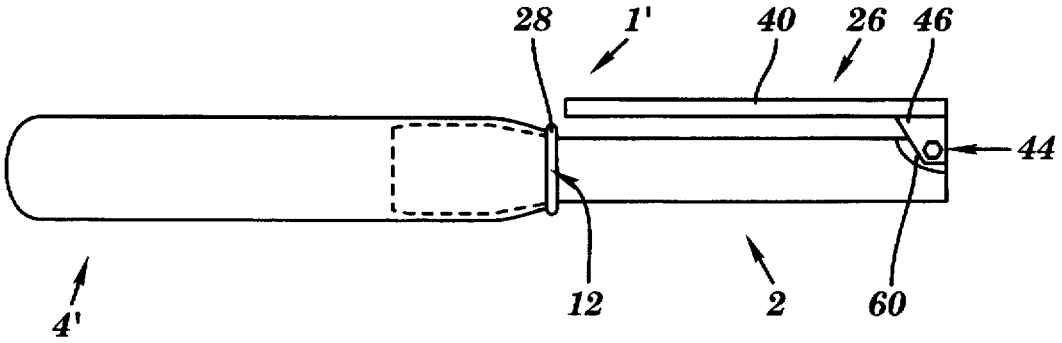
FIG. 3 is a side elevational view of a modified form of the marker flashlight shown in FIG. 1. In this view, an adjustable stand is also shown.

FIG. 3 provides a side view of a marker flashlight 1' that includes a stand 26 and a modified light tube 41. The tube 4' includes a resilient band 28 secured to the tube in a conventional manner and located whereby it encircles the opening at end 12. The band is sized so that when it is not stretched, the opening of end 12 will have a diameter less than the diameter of the flashlight's body portion. In this manner, the band will be in a stretched state whenever the light tube is positioned on the flashlight and will thereby function to retain the tube on the flashlight. When the light tube is not being used, it can be pulled further onto the body of the flashlight until end 14 is located proximate the lamp portion. As an option that is not shown, end 14 can include hook and pile fastening material and be releasably secured together to thereby enable end 14 to be opened and the tube to be completely pulled onto the body portion of the flashlight. Once the tube no longer overlies the flashlight's bulb, the flashlight can be used in the normal manner.

Figure 5:
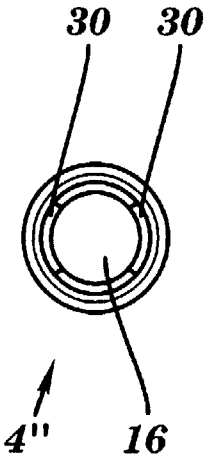
FIG. 5 is an end elevational view of the light tube shown in FIG. 4.
Figure 4:
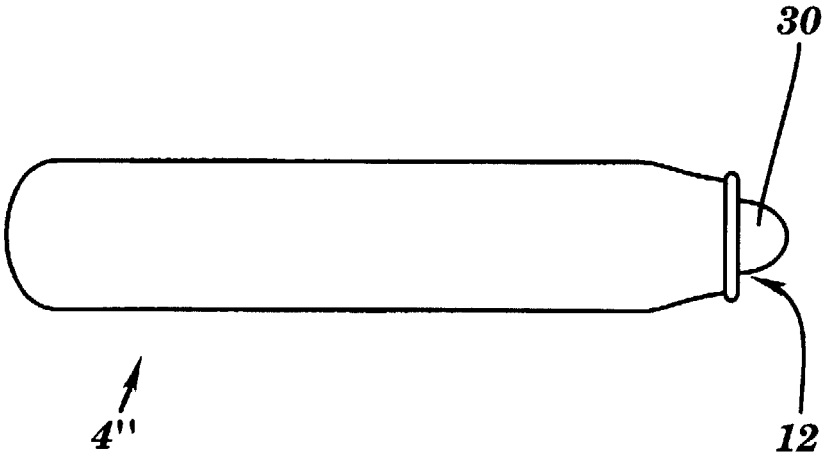
FIG. 4 is a side elevational view of an alternate embodiment of a light tube.

FIGS. 4 and 5 show a light tube 4''' modified to include a pair of rearwardly extending tabs 30 located proximate end 12. The tabs function to provide fingerholds that make it easier for a user to spread open end 12 of the tube to facilitate installing the tube onto the flashlight 2.

Figure 6:
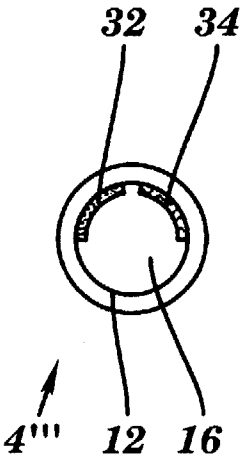
FIG. 6 is an end elevational view of a modified form of the light tube shown in FIG. 3.

FIG. 6 shows the open end 12 of a light tube 4''' modified to include two complementary strips of hook and pile fastening material, 32 and 34. The strips are located on the interior surface of the light tube proximate end 12. The opening of the light tube at end 12 is preferably greater in diameter than the lamp portion 10 of the flashlight. Once the light tube is positioned on the flashlight, the strips 32 and 34 can be pinched together to thereby secure them to each other and effectively reduce the diameter of the opening at end 12. This results in the securement of the light tube to the flashlight.

Figure 7:
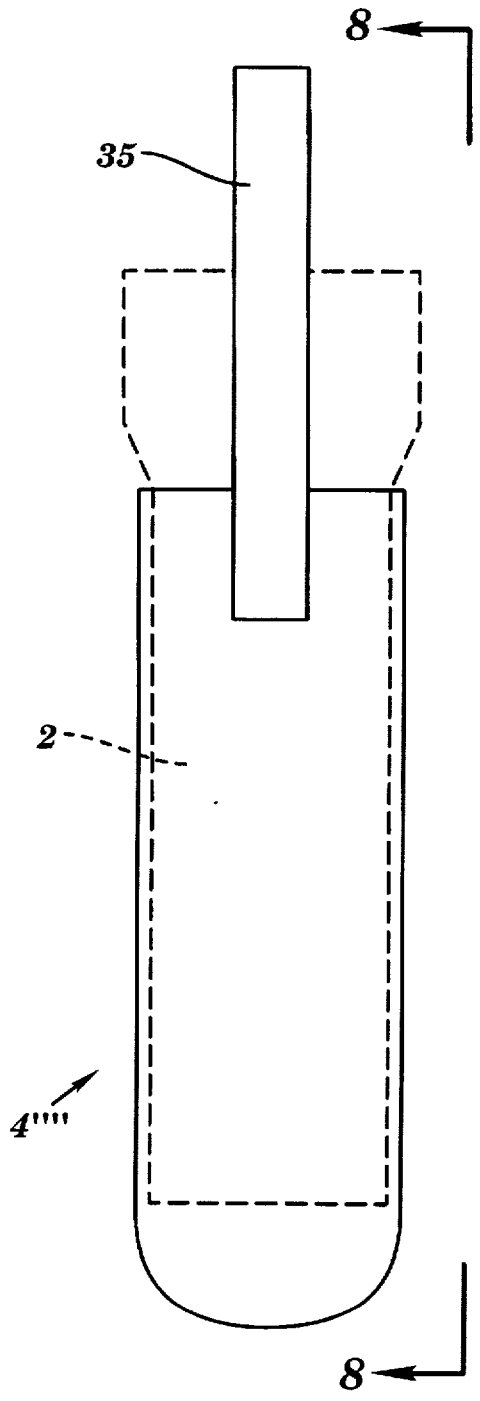
FIG. 7 is an elevational view of another alternate embodiment of a light tube. A flashlight is shown in phantom.
Figure 8:
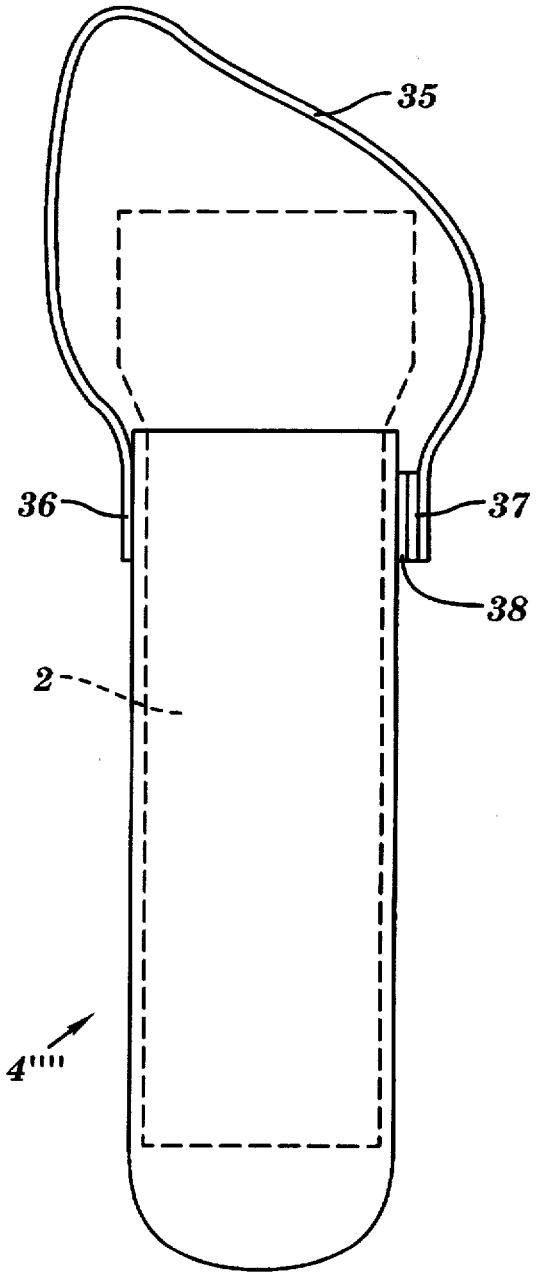
FIG. 8 is a side elevational view of the light tube shown in FIG. 7.

FIGS. 7 and 8 show another alternate embodiment of a light tube 4''''. In this embodiment, the light tube includes an added strap 35 that has one end 36 permanently secured to the light tube by sewn stitches or other conventional fastening methods. A second end 37 of the strap is releasably secured to the light tube by complementary portions of hook and pile fastening material (VELCRO). The end 37 preferably has either the hook or pile material and is releasably secured to a permanently secured pad 38 of the other of the hook and pile material. Other well-known releasable fastening means such as snap assemblies, or even a button fastener, may alternatively be employed. To releasably secure the light tube to a user, the strap is looped about the user's belt or belt loop and then the strap's free end 37 is secured to pad 38. Once the light tube has been secured to the user, the flashlight ca be inserted into the light tube via the light tube's open end and thereby be secured to the user. The flashlight can then be easily removed as may be done with conventional flashlight holders. However, if a dispersed, beacon-type light is required, the user can also detach the light tube from his or her belt or belt loop and then place it on the flashlight in the manner shown in FIG. 1 and used in the manner previously described for tube 4.

Figure 9:
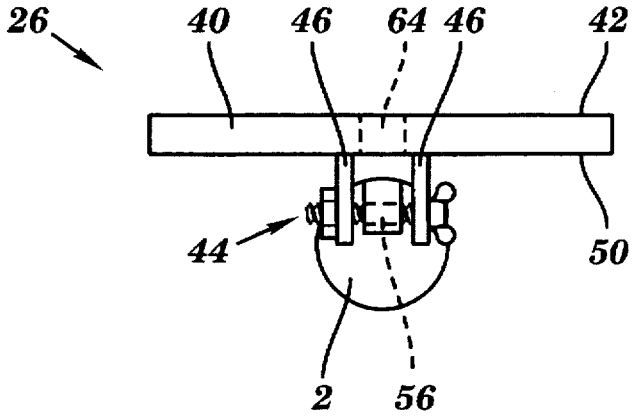
FIG. 9 is an end elevational view of the marker flashlight and stand shown in FIG. 3.
Figure 10:
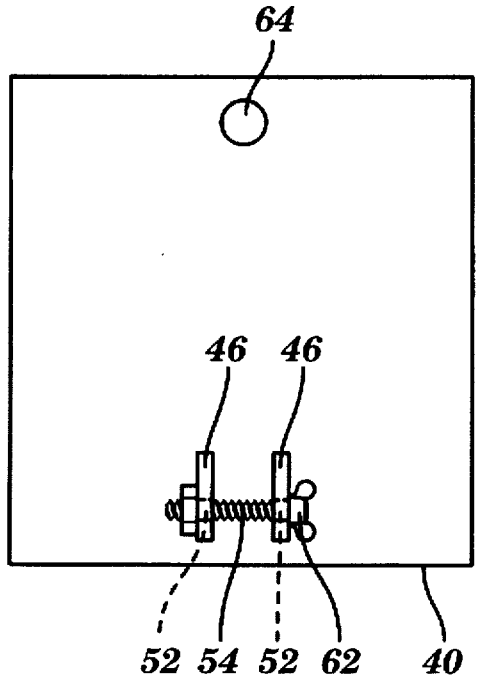
FIG. 10 is a bottom view of the stand shown in FIG. 3 and taken from a point below said stand.

A stand 26 for the flashlight 2 is shown in FIGS. 3, 9 and 10. The stand comprises a planar member 40 that has a length that is preferably in the range of two to ten inches and may be longer or shorter than the length of the flashlight. It is noted that the greater the length of the stand, the greater will be its fore-to-aft stability. The width of member 40 is preferably in the range of one to six times the diameter of the flashlight. In the preferred embodiment, member 40 is made of a substantially rigid material, such as plastic, and has a thickness of approximately one-quarter of an inch. Face 42 of member 40 may have a flat, ribbed or nubbled surface.

As shown in the figures, member 40 is secured to the rear end portion of the flashlight by an adjustable fastener apparatus 44. The apparatus comprises two triangular brackets 46 that are affixed to and extend upwardly from face 50 of the member 40. Each bracket has a thru-hole 52. As shown, a bolt 54 extends through both thru-holes and also through an aperture 56 located in a rear rib portion 60 of the flashlight. One end of the bolt is preferably non-rotatably secured to one of the brackets and a wing nut 62 is threadedly engaged to its other end. A user can rotate the wingnut to thereby tighten or loosen the contact between the brackets and the flashlight's rib portion 60. This enables the adjustment of the position of the flashlight relative to the plane defined by the member 40. It should be noted that other conventional fastening means may be used in lieu of the bolt 54 and wingnut 62 shown. For example, a threaded rod can be used in lieu of bolt 54 and a wing nut 62 can be secured to each end of the rod to adjustably secure the flashlight to the stand. In addition, the apparatus 44 can include resilient washers (not shown) adjacent to the wingnut(s) to enhance the operation of the apparatus. As another alternative, a clamp such as a hose clamp can be secured to bolt 54 and be clamped onto the body of the flashlight.

As can be seen in FIG. 10, member 40 also includes a thru-hole 64 that has a diameter of between approximately one-quarter of an inch and one inch. The thru-hole enables the stand to be hung from an existing nail or hook (not shown) whereby an end portion of the nail or hook extends through the hole 64.

The stand can also be employed to hang the flashlight from a user's belt. To accomplish this, the member 40 is slid behind a portion of the belt whereby it will be located between the belt and the user's pants. This will secure the flashlight to the user's body in a hands-free manner. To remove the flashlight from its belt-secured position, a user merely lifts upwardly on the flashlight or stand to thereby disengage member 40 from the user's belt and allow the flashlight to be used in the normal manner.

Figure 11:
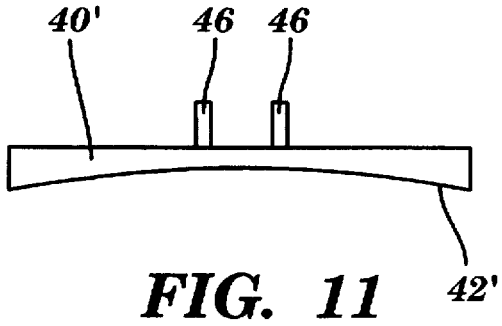
FIG. 11 is an end elevational view of a modified version of the planar member of the stand shown in FIG. 10.

An alternate embodiment of member 40 is shown in FIG. 11. In this embodiment, face 42' of member 40' is concave or bowed. This allows the member to more nearly conform to the shape of a user's hip when the stand is secured to a user's belt as described above. The concave shape may be permanent when member is made of a rigid material, or it may be temporary when member 40 is made of a slightly flexible plastic material.

Figure 13:
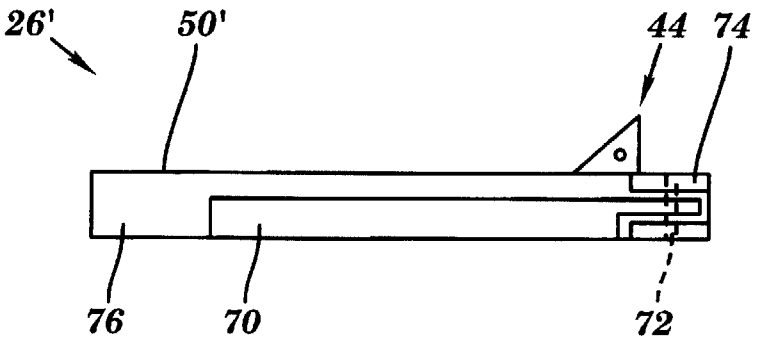
FIG. 13 provides a side elevational view of the stand shown in FIG. 12.
Figure 12:
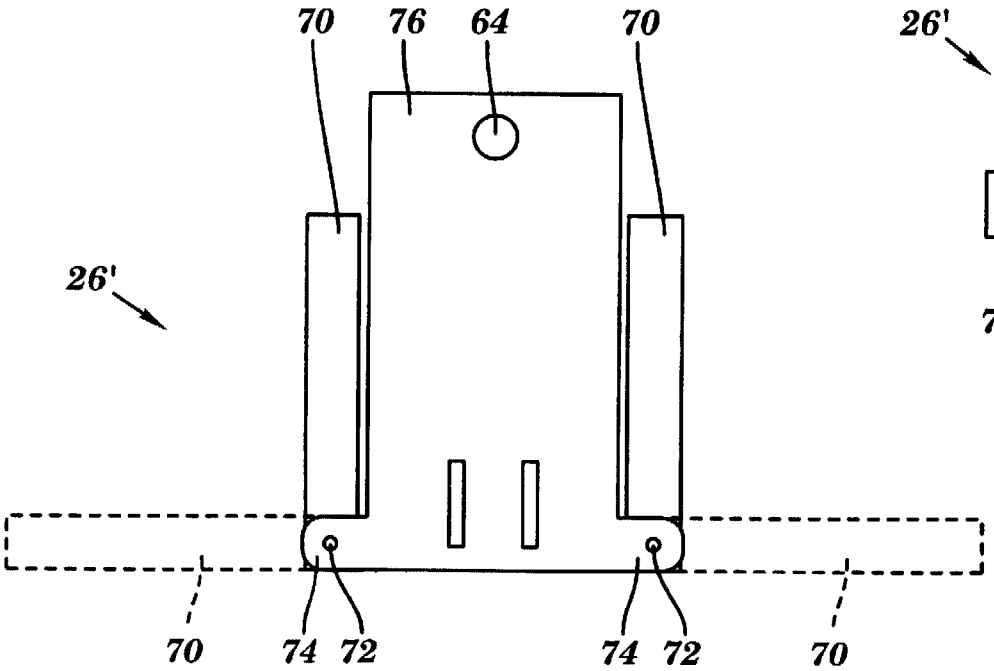
FIG. 12 is a plan view of another embodiment of the stand shown in FIG. 3. In this view, outriggers are shown in solid in a first position and in phantom in a second position.

FIGS. 12 and 13 show another embodiment of a stand 26'. In this embodiment, the stand 26' similarly includes fastener apparatus 44 secured to its surface 50' and securable to a flashlight in the same manner as taught in the previous embodiment. However, to improve the stand's stability while at the same time providing a means whereby the stand can have a reduced width, the stand 26' includes two movable outriggers 70. Each outrigger is pivotally connected by a pivot member 72 to a bracket 74 that extends outwardly from the main base portion 76.

In the preferred embodiment, portion 76 is rectangular in shape, made of a rigid material and is approximately two to eight inches long, one to four inches wide and has a thickness of from one-eighth of an inch to one inch. Each outrigger 70 is in the form of an elongated rigid bar member that has a length and thickness similar to that of portion 76. The pivotal connection between the outriggers and portion 76 enables the outriggers to pivot from a position alongside portion 76 (shown in solid in FIG. 12) to a position perpendicular to said portion (shown in phantom in FIG. 12). This enables a user to effectively increase the stability of the stand by moving the outriggers to their perpendicular position shown in phantom in FIG. 10.

Figure 14:
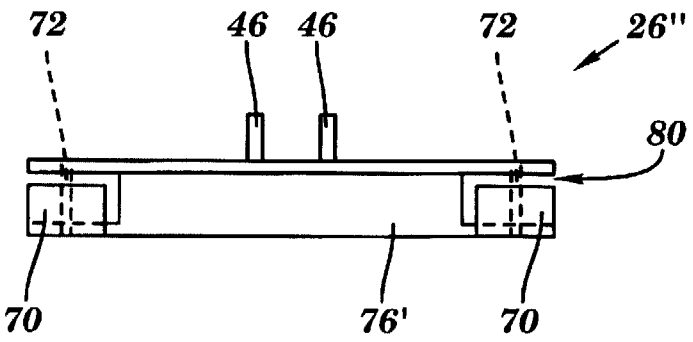
FIG. 14 provides an end elevational view of a modified version of the stand shown in FIGS. 12 and 13.

FIG. 14 shows an end view of another alternate embodiment of stand 26. This embodiment differs from the embodiment shown in FIGS. 10 and 11 only in that the brackets 74 are incorporated into portion 76 and that the outriggers 70 are received within complementary slots 80 in the sides of the portion 76' when they are not in their outwardly extending orientation (shown in phantom in FIG. 12). As in the previous embodiment, the outriggers are pivotally secured at end portions thereof by pivot members 72.

It should be noted that the stand 26 is complementary to the light tube 4 since, when it is used on a flashlight in which the light tube is secured to the flashlight's lamp portion, it enables the modified flashlight to function as a self-standing lantern or as a marker or beacon that can be hung from a user's belt. It should also be noted however that the light tube and stand do not have to be used in combination and can be employed separately on a flashlight.

While a number of securement means are taught for securing the light tube 4-4"" to a flashlight (ranging from a tight fit to the use of added securement structures), other conventional securement methods may alternatively be employed.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A marker flashlight comprising:

a flashlight having a body portion and a lamp portion and wherein said lamp portion is capable of projecting a narrow beam of light;

a flexible light tube member having a tubular shape, an open first end, a closed second end, a hollow interior and is made of a translucent, semi-reflective rip-stop nylon fabric material; and wherein the open first end of the light tube member is capable of being secured by a securement means to the lamp portion of said flashlight and wherein when said flashlight is actuated, light from said flashlight will enter said hollow interior area of said light tube member and be partially reflected by the material of said light tube member so that light will be emitted from a major portion of said light tube member.

2. The marker flashlight of claim 1 further comprising a securement cord attached at a first end to said light tube member and at a second end to said flashlight.

3. The marker flashlight of claim 1 wherein the open first end of the light tube member includes at least one tab means that extends outwardly from a major portion of said light tube member and functions as a convenient area onto which a user can grab in order to pull said light tube member at least partially onto an end of said flashlight.

4. The marker flashlight of claim 1 further comprising a resilient member secured to said light tube member and located proximate the open first end of said light tube member and wherein when the light tube member is placed onto the lamp portion of the flashlight, the resilient member is stretched and thereby functions as said securement means to maintain the light tube member on the flashlight.

5. The marker flashlight of claim 1 further comprising complementary sections of hook and loop fastening material secured to said light tube member and located proximate the open first end of said light tube member and wherein said sections of fastening material can be pressed together to thereby reduce a size dimension of an opening located at the open first end of the light tube member to thereby function as said securement means to maintain the light tube member on the flashlight.

6. The marker flashlight of claim 1 wherein the body portion of said flashlight has a predetermined diameter and wherein the hollow interior of the light tube member has a diameter at least equal to that of the body portion of the flashlight.

7. The marker flashlight of claim 1 further comprising a shape-maintaining means that functions to maintain the light tube member in an extended condition.

8. The marker flashlight of claim 7 wherein the shape-maintaining means is in the form of a substantially rigid rod secured to said light tube member and having a length that is substantially equal to that of the light tube member.

9. The marker flashlight of claim 1 wherein the light tube member includes a releasable attachment means that is capable of releasably attaching the light tube member to an article of a user's clothing.

10. The marker flashlight of claim 9 wherein the releasable attachment means comprises a strap means that has one end that can be releasably attached to the light tube member.

11. The marker flashlight of claim 1 wherein the light tube member has at least a portion thereof coated with a phosphorescent material whereby said coated portion is capable of glowing with light even when the flashlight is not producing light.

12. The marker flashlight of claim 1 further comprising a stand means releasably and adjustably secured to the body portion of the flashlight by an adjustable securement means and wherein the stand means comprises a base member that has a width dimension that is at least equal to a width dimension of the body portion of the flashlight.

13. The marker flashlight of claim 12 wherein the stand means includes width adjustment means that can be adjusted by a user to change a width dimension of the base member.

14. The marker flashlight of claim 13 wherein the width adjustment means includes at least one outrigger pivotally secured to a major portion of the base member.

15. A marker flashlight comprising:

a flashlight having a body portion and a lamp portion and wherein said lamp portion is capable of projecting a narrow beam of light;

a flexible light tube member having a tubular shape, an open first end, a hollow interior and is made of a translucent, semi-reflective material;

a securement cord attached at a first end to said light tube member and at a second end to said flashlight; and wherein the open first end of the light tube member is capable of being secured by a securement means to the lamp portion of said flashlight and wherein when said flashlight is actuated, light from said flashlight will enter said hollow interior area of said light tube member and be partially reflected by the material of said light tube member so that light will be emitted from a major portion of said light tube member.

16. A marker flashlight comprising:

a flashlight having a body portion and a lamp portion and wherein said lamp portion is capable of projecting a narrow beam of light;

a flexible light tube member having a tubular shape, an open first end, a hollow interior and is made of a translucent, semi-reflective material;

a shape-maintaining means in the form of a substantially rigid rod secured to said light tube member and having a length that is substantially equal to that of the light tube member and that functions to maintain the light tube member in an extended condition; and wherein the open first end of the light tube member is capable of being secured by a securement means to the lamp portion of said flashlight and wherein when said flashlight is actuated, light from said flashlight will enter said hollow interior area of said light tube member and be partially reflected by the material of said light tube member so that light will be emitted from a major portion of said light tube member.

17. A marker flashlight comprising:

a flashlight having a body portion and a lamp portion and wherein said lamp portion is capable of projecting a narrow beam of light;

a flexible light tube member having a tubular shape, an open first end, a hollow interior and is made of a translucent, semi-reflective material; and wherein the open first end of the light tube member is capable of being secured by a securement means to the lamp portion of said flashlight, wherein when said flashlight is actuated, light from said flashlight will enter said hollow interior area of said light tube member and be partially reflected by the material of said light tube member so that light will be emitted from a major portion of said light tube member, and wherein the light tube member has at least a portion thereof coated with a phosphorescent material whereby said coated portion is capable of glowing with light even when the flashlight is not producing light.

* * * * *